US009932202B2

(12) United States Patent
Langeman

(10) Patent No.: US 9,932,202 B2
(45) Date of Patent: Apr. 3, 2018

(54) SPOOL HOLDER

(71) Applicant: Langeman Manufacturing Limited, Leamington (CA)

(72) Inventor: Gary D. Langeman, Leamington (CA)

(73) Assignee: LANGEMAN MANUFACTURING LIMITED, Leamington (CA)

( * ) Notice: Subject to any disclaimer, the term of this patent is extended or adjusted under 35 U.S.C. 154(b) by 167 days.

(21) Appl. No.: 14/439,552

(22) PCT Filed: Oct. 31, 2012

(86) PCT No.: PCT/CA2012/001010
§ 371 (c)(1),
(2) Date: Apr. 29, 2015

(87) PCT Pub. No.: WO2014/066971
PCT Pub. Date: May 8, 2014

(65) Prior Publication Data

US 2015/0298935 A1 Oct. 22, 2015

(51) Int. Cl.
*B65H 75/10* (2006.01)
*B65H 49/32* (2006.01)
*B65H 49/20* (2006.01)

(52) U.S. Cl.
CPC ..... *B65H 75/10* (2013.01); *B65H 49/205* (2013.01); *B65H 49/327* (2013.01); *B65H 2401/213* (2013.01); *B65H 2701/377* (2013.01); *B65H 2701/5122* (2013.01); *B65H 2701/526* (2013.01)

(58) Field of Classification Search
CPC ..... B65H 49/205; B65H 49/327; B65H 2401/213; B65H 2701/377; B65H 2701/5122; B65H 2701/526; B65H 75/10
USPC ..... 242/613
See application file for complete search history.

(56) References Cited

U.S. PATENT DOCUMENTS 737,407 A * 8/1903 Hirsch ..... B65H 75/10 16/2.1
2,677,425 A * 5/1954 Broyles ..... B65H 35/0026 225/26
3,753,839 A * 8/1973 Funke ..... B65H 35/0033 156/527
3,762,261 A * 10/1973 Ekenberg ..... B65H 35/002 225/43
3,892,369 A 7/1975 Fujawa
4,328,932 A * 5/1982 Nelson ..... G11B 23/037 242/609.3
4,570,837 A * 2/1986 Belokin ..... B65H 35/0026 225/42
4,626,950 A * 12/1986 Livermore ..... B65H 75/22 242/571
4,884,734 A * 12/1989 Kahl, Jr. ..... B65H 35/0026 225/26
4,915,769 A * 4/1990 Heil ..... B65C 11/002 156/527

(Continued)

*Primary Examiner* — Michael E Gallion
(74) *Attorney, Agent, or Firm* — Kagan Binder, PLLC

(57) ABSTRACT

The present invention is a spool holder that is an insert for inserting in the hole in a spool to frictionally engage the inner surface of the spool, and having an attachment mechanism that allows the insert to be attached to a surface, such as the vertical metallic side of a car. The attachment mechanism may include a number of magnets disposed in receptacles in the insert, or a number of small suction cups on the lateral sides of the insert.

12 Claims, 7 Drawing Sheets

(56) References Cited

U.S. PATENT DOCUMENTS 4,978,083 A * 12/1990 Kim ..... G11B 15/32 242/530.1
4,990,214 A * 2/1991 Heil ..... B65C 11/002 156/527
5,366,129 A * 11/1994 Nakamura ..... B65H 35/0026 225/42
5,375,791 A * 12/1994 Kline ..... G11B 15/32 242/575
5,549,255 A * 8/1996 Huang ..... B65H 35/0033 156/579
5,641,109 A * 6/1997 Willoughby ..... B65H 35/0026 224/162
5,641,377 A * 6/1997 Chung ..... B65H 35/0033 156/523
5,667,626 A * 9/1997 Cayford ..... B05B 15/0456 156/527
5,683,058 A * 11/1997 Schwarz ..... B65H 16/04 242/578.2
5,906,705 A 5/1999 Chung et al.
5,954,916 A * 9/1999 Orlandi ..... B41F 17/13 156/385
D453,355 S * 2/2002 Potter ..... D19/69
6,540,002 B1 * 4/2003 Edwards ..... B44C 7/06 156/574
6,695,190 B1 * 2/2004 Gunter, Jr. ..... B65H 35/002 156/527
6,705,373 B1 * 3/2004 Yu Chen ..... B65H 35/0033 156/523
7,191,979 B2 * 3/2007 Paukov ..... B65H 75/185 242/578.2
7,232,088 B2 * 6/2007 Asano ..... G11B 23/037 242/348
7,287,720 B1 * 10/2007 Allegre ..... A47K 10/38 206/409
D565,663 S * 4/2008 Yu Chen ..... D19/69
9,463,950 B2 * 10/2016 Yu Chen ..... B65H 75/185
9,493,322 B1 * 11/2016 Lam ..... B65H 35/0033
9,637,345 B2 * 5/2017 Huang ..... B65H 75/10
2003/0173452 A1 * 9/2003 Huang ..... B65H 35/0033 242/588
2004/0004146 A1 * 1/2004 Ishihara ..... G03B 23/02 242/348
2006/0169709 A1 * 8/2006 Bailey ..... B65H 35/0033 221/26
2007/0267148 A1 * 11/2007 Steele ..... B65H 35/0026 156/577
2008/0067211 A1 * 3/2008 Steele ..... B65H 35/0026 225/77
2012/0061414 A1 * 3/2012 Bundy ..... B65H 35/0073 221/1
2014/0027558 A1 * 1/2014 Kawauchi ..... B65H 75/245 242/571
2014/0158810 A1 * 6/2014 Cattacin ..... A47K 10/38 242/596.4
2015/0203325 A1 * 7/2015 Briggs ..... B65H 49/205 242/588
2016/0058161 A1 * 3/2016 Brennan ..... B65H 35/0026 224/162

* cited by examiner

SPOOL HOLDER

PRIORITY CLAIM

This application claims benefit from International Application No. PCT/CA2012/001010, filed Oct. 31, 2012, the disclosure of which is incorporated herein by reference in its entirety.

FIELD OF THE INVENTION

The present invention relates generally to devices for holding a spool, and more particularly to devices for removably attaching to a surface a spool holding a roll of material.

BACKGROUND OF THE INVENTION

Various materials are formed into rolls, such as tape, thermal paper, wire, fishing line, and film. Such material is flexible and generally relatively thin. Commonly, the roll is formed by winding the material onto a spool. A basic spool (e.g. item 101 of FIG. 1), which may be referred to as a "core", has right circular cylindrical inner and outer surfaces, having open ends and usually being relatively thin in the radial direction. Such a core may be formed from paper, plastic, metal or cardboard, for example. In some cases, the walls may be thicker to provide more resistance to deformation. The cylindrical opening in the middle of the spool is useful for holding the roll or for placing it on a spindle so that the roll may rotate about the central axis of the spool as material is removed from the roll.

Other forms of a spool, referred to as reels (e.g. item 600 of FIG. 6), have lateral sides extending radially outward from the ends of an open-ended cylindrical core. For holding flat material, the two lateral sides are spaced apart by a width slightly more than the width of the material, such as in a film reel. This is useful for materials that are not adhesive so that they may not form a stable roll by just wrapping the material around itself.

In many cases, rolls of material are used manually by people. For example, a painter may hold a roll of masking tape in his hand and pull a portion of the tape off the roll. To apply the tape to a wall or side of a car being painted, it is generally necessary for the painter to tear a portion of tape off the roll, put the roll down somewhere, such as in a pocket, and then use two hands to apply the tape to the surface. This limits the length of a continuous piece of tape that can be applied by one person. In order to apply a very long continuous piece of tape, the painter may require the help of a second person who holds the roll of tape while the painter uses two hands to apply each portion while one end is still attached to the roll so that a further portion, connected to the previous portion, may then be removed from the roll and similarly applied to the surface as one continuous piece. Such a continuous piece makes removal faster and cleaner. The user does not have to pick at numerous edges to restart the de-masking process.

In general, for example when working in a garage or a shop, there may be no suitable horizontal surfaces to place the tape down on while the user is applying a strip. Such locations may also be dirty so that the edges of the tape may become dirty when laid down.

SUMMARY OF THE INVENTION

The following presents a simplified summary of the disclosure in order to provide a basic understanding to the reader. This summary is not an extensive overview of the disclosure and it does not necessarily identify key/critical elements of the invention or delineate the scope of the invention. Its sole purpose is to present some concepts disclosed herein in a simplified form as a prelude to the more detailed description that is presented later.

The present invention provides a spool holder for holding a spool, the spool having a width and an inner cylindrical surface defining a cylindrical hole having a diameter, the spool holder comprising:

(a) an insert having an outer surface configured to releasably engage the inner surface of the spool to create an interference fit between the outer surface of the insert and the inner surface of the spool when the insert is inserted into the hole; and (b) an attachment mechanism for releasably attaching the insert to a supporting surface.

The outer surface of the insert may have a plurality of spool contact points separated from each other by troughs in the outer surface. The insert has a central axis and each contact point may comprise a portion of the outer surface of the insert, a plurality of the contact points may be at a distance greater than one half of the inner diameter of the spool from the central axis, and the contact points may be angularly spaced apart to engage the inner surface of the spool to produce an interference fit.

The insert may have left and right lateral sides perpendicular to the central axis, and a width being the distance between the lateral sides, wherein the outer surface is bordered by the lateral sides.

All portions of the insert may be located at a distance from the central axis of less than or equal to one half of the maximum distance of any contact point from any other contact point.

The insert may comprise a sleeve having a hole centered on the central axis of the sleeve. The hole may be a cylindrical hole having a diameter equal to at least 50% of the inner diameter of the spool.

Each spool contact point may be the same distance from the central axis, the distance being less than 0.53 times the inner diameter of the spool and the distance being greater than one half of the inner diameter of the spool.

The insert may comprise eight contact points, each contact point being angularly spaced apart from the other seven contact points by at least forty degrees. The portions of the outer surface between the eight contact points may be closer to the central axis than the contact points.

The insert may comprise sixteen contact points, each contact point being angularly spaced apart from the other fifteen contact points by at least twenty degrees.

The attachment mechanism may comprise magnetized material and the supporting surface may comprise ferromagnetic material.

The insert may comprise magnetized material so that the attachment mechanism comprises the magnetized material.

The insert may comprise a receptacle configured to receive a magnet, the attachment mechanism may comprise a magnet disposed in the receptacle, and the width of the insert may be greater than the width of the spool.

The insert may comprise a plurality of receptacles configured to receive magnets, and the attachment mechanism may comprise a plurality of magnets disposed in the receptacles. The magnets may be cylindrical and be oriented with their central axes parallel to the central axis of the insert and the magnets may extend from near one lateral side of the insert to near the other lateral side so that each magnet can magnetically engage with a supporting surface comprising ferromagnetic material when either lateral side of the insert is placed in close proximity to the supporting surface. The spool holder may be engageable with a spool holding a roll of material and attachable to a vertical surface comprising ferromagnetic material, and the magnetic strength of the magnetized material may be sufficient to maintain the attachment to the surface.

The insert may be formed from plastic.

The attachment mechanism may comprise a suction cup. The attachment mechanism may comprise a plurality of suction cups angularly distributed on one lateral surface of the insert, and the width of the insert may be greater than or equal to the width of the spool. The attachment mechanism may comprise a plurality of suction cups angularly distributed on both lateral surfaces of the insert The insert may comprise an outer sleeve having a cylindrical hole centered on the central axis of the sleeve, and the attachment mechanism may comprise an inner hub rotatably attached to the sleeve. The hub may comprise a receptacle configured to receive a magnet, and a magnet disposed in the receptacle, wherein the insert has a width greater than the width of the spool. The hub may comprise a plurality of suction cups angularly distributed on one lateral surface of the hub, and the insert may have a width greater than or equal to the width of the spool.

The present invention also provides a method of using a spool holder for holding a spool, the spool having a width and an inner cylindrical surface defining a cylindrical hole having a diameter, the spool holder comprising:

(a) an insert having an outer surface configured for releasable engagement with the inner cylindrical surface of the spool, the insert having a central axis, two lateral sides and a plurality of spool contact points, each contact point comprising a point on the outer surface of the insert, a plurality of the contact points being at a distance greater than one half of the inner diameter of the spool from the central axis, the contact points being distributed to engage the inner surface of the spool to produce an interference fit between the outer surface of the insert and the inner cylindrical surface of the spool when the insert is inserted into the hole; and (b) an attachment mechanism for releasably attaching one of the lateral sides of the insert to a supporting surface, the method comprising the steps of:

(a) inserting the insert into the cylindrical hole in the spool to bring the contact points into frictional engagement with the inner cylindrical surface of the spool; and (b) attaching one of the lateral sides of the insert to a supporting surface using the attachment mechanism.

The spool holder employed in the method may include additional features as described above. In the case of a spool holder comprising an outer sleeve rotatable about an inner hub, the method may further include the step of (c) removing material wound on the spool by pulling the material, causing the insert to rotate about the hub while it is attached to the supporting surface.

The present invention also provides a kit comprising:

(a) a spool holder comprising:

i. an insert having an outer surface configured for releasable engagement with a spool, the spool having an inner cylindrical surface defining a cylindrical hole having a diameter, the insert having a central axis, two lateral sides and a plurality of spool contact points, each contact point comprising a point on the outer surface of the insert, a plurality of the contact points being at a distance greater than one half of the inner diameter of the spool from the central axis, the contact points being distributed to engage the inner surface of the spool to produce an interference fit between the insert and the inner cylindrical surface of the spool when the insert is inserted into the hole; and ii. an attachment mechanism for releasably attaching one of the lateral sides of the insert to a supporting surface; and (b) a medium containing instructions for using the spool holder to attach a spool to a supporting surface.

DETAILED DESCRIPTION OF THE INVENTION

Figure 1:
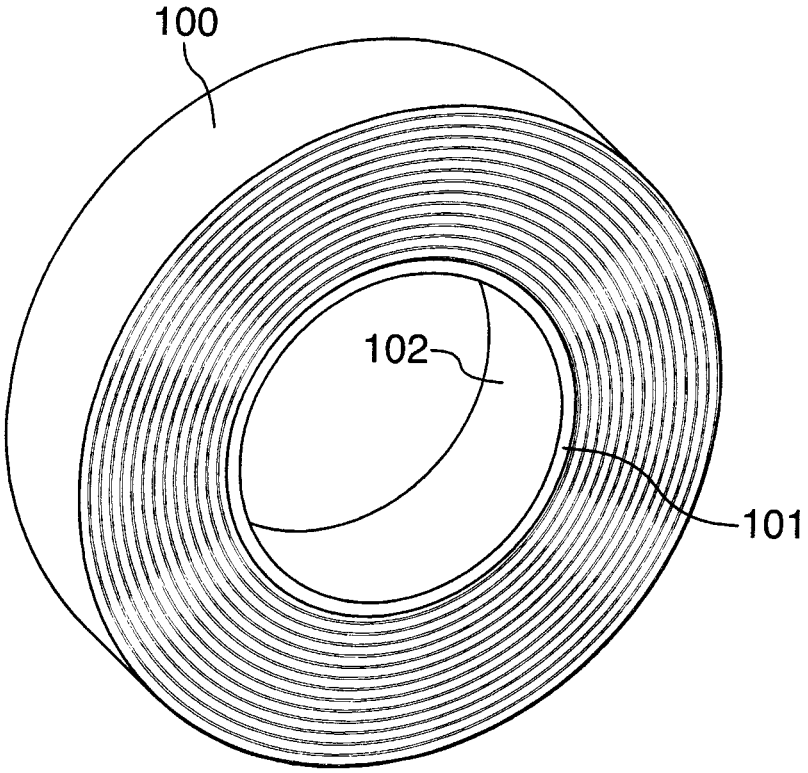
FIG.1 (Prior Art)
FIG. 1 is a perspective view of a roll of tape on a spool.

The invention is a spool holder for releasably attaching to a supporting surface a spool having a cylindrical inner surface defining a cylindrical hole or opening through the spool. An example of a typical roll of tape is shown in FIG. 1, the tape 100 being wound around a cylindrical spool 101, which may be referred to as a "core", having a cylindrical inner surface 102. The inner diameter of the spool is the twice the distance from the central axis of the spool to the inner surface 102, the central axis being the axis of the cylinder defined by the inner surface 102.

Figure 2:
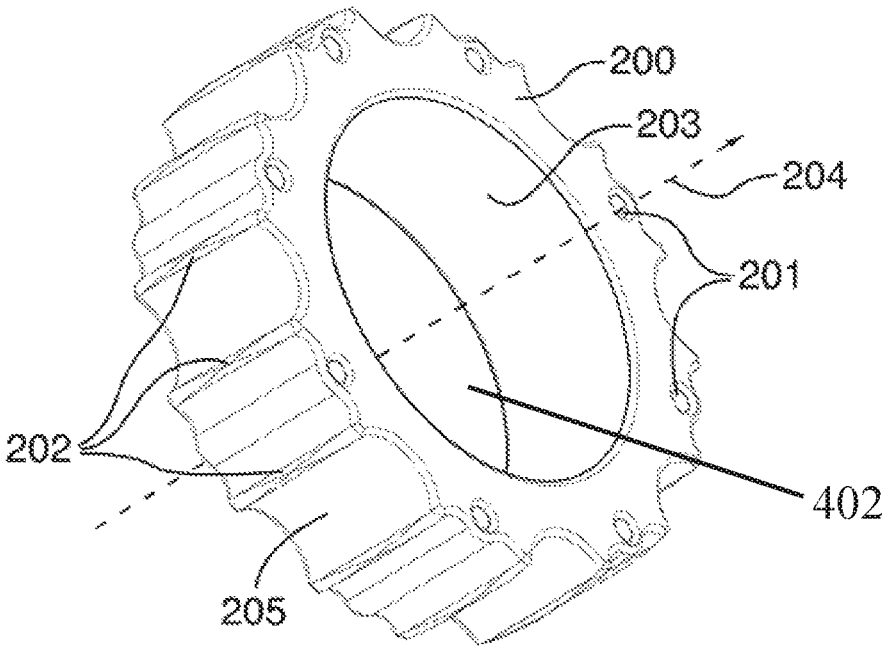
FIG. 2 is a perspective view of a first embodiment of a spool holder having a scalloped outer surface and embedded magnets as an attachment mechanism.

A first embodiment of a spool holder is shown in FIG. 2. The holder consists of an insert 200 having a central axis 204 with eight magnets 201 embedded in the insert 200 with the magnets recessed from the lateral surfaces of the insert 200 so that they do not directly contact a ferromagnetic supporting surface when the holder engages (i.e. is attached to) such a supporting surface. However, the magnets are close enough to the supporting surface to magnetically engage it.

The magnets 201 extend from near one lateral side of the insert through the insert to near the other lateral side so that each magnet 201 can magnetically engage with a flat supporting surface comprising ferromagnetic material when either lateral side of the insert is placed in close proximity with the supporting surface. The inner surface 203 of the holder may be cylindrical and define a cylindrical hole 402 (or opening) through the holder.

Figure 3:
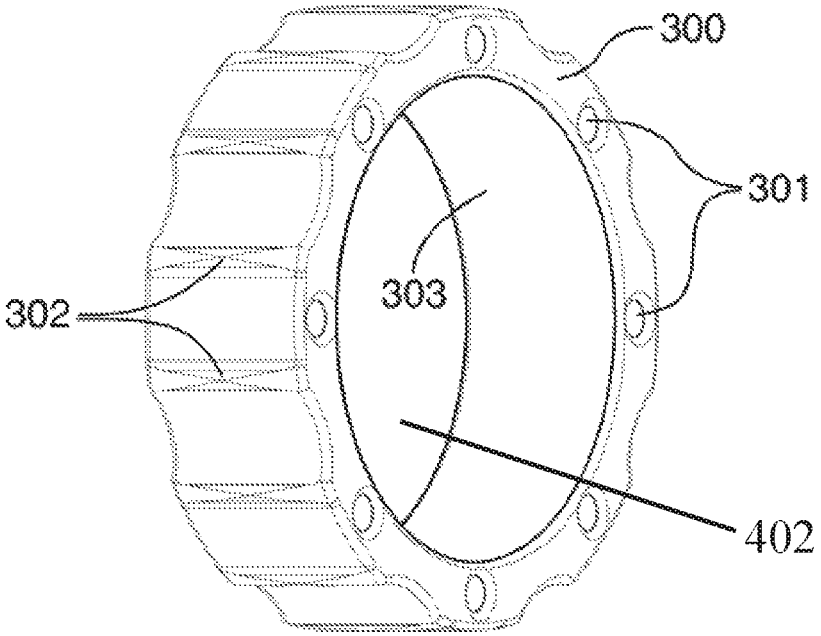
FIG. 3 is a perspective view of a second embodiment of a spool holder having a scalloped outer surface with no embedded magnets.

A second embodiment is shown in FIG. 3 without magnets inserted. The insert 300 has eight receptacles 301 configured to receive eight cylindrical magnets. Each receptacle is cylindrical with its axis parallel to the central axis of the insert. As with the first embodiment, the inner surface 303 of the holder is cylindrical and defines a cylindrical hole 402 through the holder.

While the holder is generally annular in shape, the annulus having a central axis 204, the outer surface of the insert is preferably scalloped, as shown in FIGS. 2 and 3, so that it has a finite number of contact points 202, 302. The term "contact point" is used to refer to a portion of the outer surface that is at a locally maximal distance from the central axis 204 of the holder. The contact point may be a portion of the surface, as items 202 and 302 in FIGS. 2 and 3 respectively, comprising a laterally extended set of surface points at about the same distance from the central axis 204, the distance being locally maximal, the contact point preferably being relatively narrow in the angular direction. The angle between two points refers to the angle between lines from each point to the central axis 204, where the lines are perpendicular to the central axis 204. It is preferred that the distance of each contact point from the central axis 204 of the holder be equal, as in the depicted embodiments, so that they lie on a notional cylinder, with a diameter referred to as the holder diameter (or outer diameter), and having a central axis coincident with the central axis 204 of the holder, which is also coincident with the central axis of a spool when the holder is engaged with the spool.

Portions of the outer surface are preferably curved inwardly, as shown in FIG. 2, which may be referred to as being scalloped. Such an arrangement limits the number of contact points and causes them to be angularly spaced apart by portions 205 of the surface closer to the central axis 204. Such portions 205 may be referred to as troughs (or alternatively as splines or cutouts), although it is not necessary that they be smoothly curved to produce a scalloped pattern as shown in the figures.

While not preferred, the insert may have no inner surface or hole through it. Also, the outer surface may be purely cylindrical, so that every point on the surface is a contact point and the insert is a disk, although this is also not preferred.

When the insert has a hole centered on the central axis, it may be referred to as a sleeve. Such embodiments are preferred because the hole can have practical utility, such as allowing the holder, with or without a spool attached, to be placed on a horizontal rod or spindle for storage, or to allow the holder and spool to rotate about a spindle while material is removed from the spool. It is generally preferred that the holder be relatively thin in the radial direction so that the cylindrical hole has a diameter equal to at least 50% of the inner diameter of the spool, and preferably at least 70%, so that the hole in the spool is not substantially narrowed by the insertion of the holder.

A solid disk is not preferred because (1) it uses more material than necessary, (2) a cylindrical hole is useful, and (3) a solid disk allows for less deformation of the spool so that the outer diameter of the holder can only be very slightly larger than the inner diameter of the spool to permit a user to engage the holder with the spool, resulting in a poorer interference fit than with a scalloped design, and making it more difficult to engage the holder with a spool.

A purely annular shape is also not preferred because it also uses more material than necessary and suffers from the same problem as a disk in respect of its fit with a spool and the difficulty of engaging it with a spool.

Figure 4:
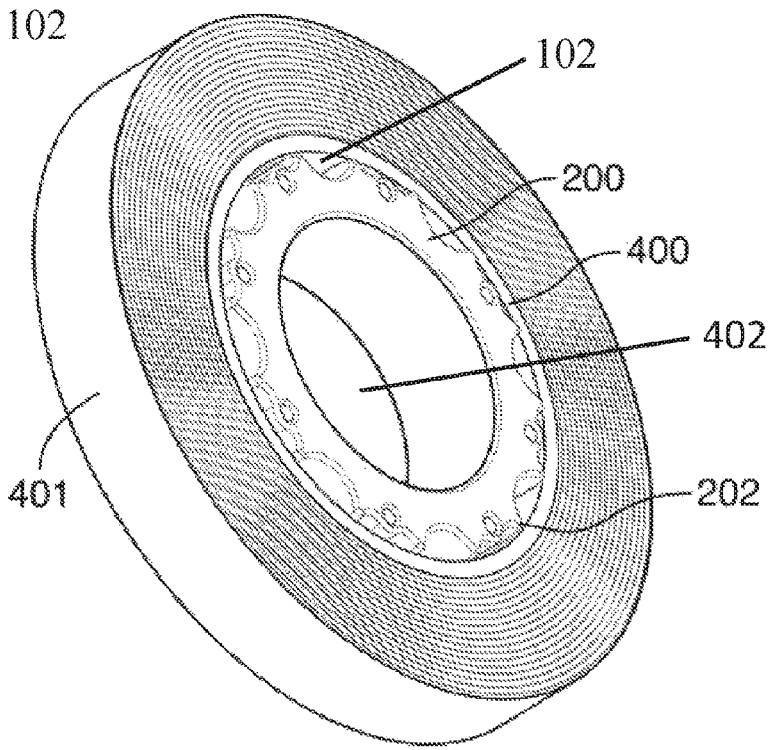
FIG. 4 is a perspective view of the first embodiment of a spool holder engaged with a spool holding a roll of tape.
Figure 5:
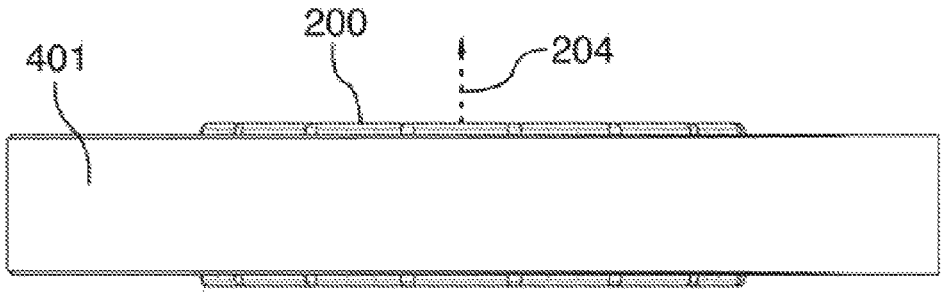
FIG. 5 is a top view of the first embodiment of a spool holder engaged with a spool holding a roll of tape.

The holder is designed to releasably engage the inner surface of a spool having an inner diameter slightly smaller than the outer diameter of the holder to produce an interference fit, as shown in FIGS. 4 and 5. A user can push the insert 200 into the cylindrical opening through such a spool 400 of tape 401. The fact that the outer diameter of the holder is slightly larger than the inner diameter of the spool causes the contact points 202 to abut and apply force to the inner surface of the spool, producing an interference fit. The spool is generally made of a somewhat deformable material, such as paper, so that it can accommodate an insert with an outer diameter slightly greater than the spool's inner diameter.

The insert has a minimum of two contact points, but preferably has eight or more contact points that are distributed uniformly angularly. With eight contact points, it is preferred that each contact point be angularly spaced apart from the other seven contact points by at least 40 degrees, and, more preferably, that each is separated from the neighbouring contact points by an angle of about 45 degrees. With sixteen contact points, it is preferred that each contact point be angularly spaced apart from the other fifteen contact points by at least 20 degrees, and, more preferably, each is separated from the neighbouring contact points by an angle of about 22.5 degrees.

When there are fewer contact points, the contact points being angularly spaced apart by portions of the outer surface closer to the central axis (troughs), the spool can generally deform more so that embodiments with fewer contact points should have a somewhat larger outer diameter to fit a given spool than would an embodiment with more contact points. For example, the spool contact points may be at a distance of 0.53 times the inner diameter of the spool from the central axis so that the outer diameter of the holder is about 1.06 times the inner diameter of the spool. The precise ratio depends on the material used for the spool and the holder, and the number and distribution of contact points, but the preferred holder outer diameter varies from very slightly greater than the inner diameter of the spool, to 1.06 or more times the inner diameter of the spool.

In the limit, when every point on the outer surface is a contact point (i.e. the outer surface is cylindrical), as discussed above, the outer diameter of the holder may be only very slightly greater than, or nearly equal to, the inner diameter of the spool.

In the embodiments shown in FIGS. 2-6, the holder includes an attachment mechanism consisting of a number of magnets embedded in the insert. While one magnet may be sufficient, it is preferred that a plurality of magnets, such as four or eight, angularly distributed within the insert, be used. As shown in FIG. 3, the sleeve 300 may have a number of receptacles 301 that are sized to receive magnets. In the depicted embodiments, the magnets 201 are cylindrical, and sized so that they are slightly recessed relative to the lateral surfaces of the sleeve 200. It is preferred that the magnets 201 extend substantially though the width of the sleeve 200, so that their axes are parallel to the central axis of the insert and the central axis of the spool when the sleeve 200 is engaged with a spool. Then a portion of each magnet is close to each lateral side of the sleeve 200. This allows either lateral side of the holder to be attached to a flat surface made of a ferromagnetic material (material to which a magnet, or magnetized material, can magnetically attach), such as a metallic compound including iron, nickel or cobalt. For example, the holder can be releasably attached to the side of most cars or the side of metal tool cabinets and work benches. When the holder is engaged with a roll of tape, for example, this allows the tape to be temporarily attached to the side of a car while a user is applying tape from the roll to the car using both hands. After applying a portion of tape without having torn it off the roll, the user can then disengage the roll from the car by pulling it so that the magnets are no longer proximate to the car, and then remove more tape from the roll and repeat the process, if desired.

Figure 11:
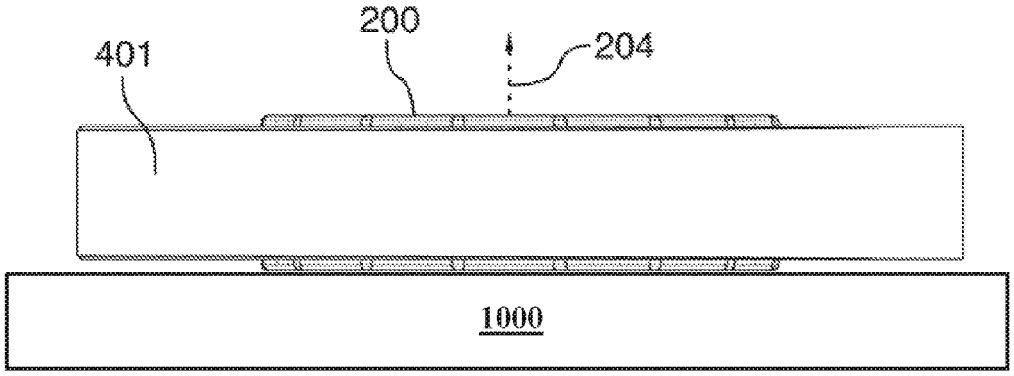
FIG. 11 is a top view of the first embodiment of a spool holder engaged with a spool holding a roll of tape with the spool holder attached to a supporting surface.

It is preferred that the width of the insert 200 be slightly greater than the width of the spool, as can be seen in FIG. 5 and in FIG. 11 where the insert 200 is engaged with a supporting surface 1000. This allows the magnets to be very close to the metallic support surface and also may make it easier for a user to grasp a roll on the spool to remove it from the support surface. It is preferred that the magnets not extend to or past the lateral surface of the insert so that the magnets do not directly contact the support surface, which may result in scratching of the surface. For the same reason, it is preferred that the insert be formed from relatively soft material, such as a plastic like a soft vinyl, that will not scratch a painted metallic surface.

The magnets are selected so that, when the holder is engaged with a spool holding a roll of material and attached to a vertical surface comprising ferromagnetic material, the combined magnetic strength of the magnets is sufficient to maintain the attachment to the surface so that the holder, spool and material wound on the spool remain in the same position relative to the supporting surface until an external force other than gravity acts on them (such as a person's hand). The strength of the magnets is generally selected to be substantially greater (e.g. two times greater) that the strength needed to attach to the side of a car a spool with the heaviest roll of material expected to be wound on it. With such a magnetic strength, it is still easy for a user to remove the roll from the supporting surface using a relatively light force.

Rather than using receptacles into which a magnet may be inserted, as shown in the figures, the insert may alternatively be formed from a magnetized material, such as iron. Although it is not preferred, the entire insert may be made of a magnetized material, so that the insert is a magnet. This is not preferred because magnetic materials may result in scratching of the support surface. This can be addressed by coating the magnetic material in a plastic coating, for example, or by embedding the magnetized material, e.g. a number of small magnets, inside a plastic carrier.

Figure 6:
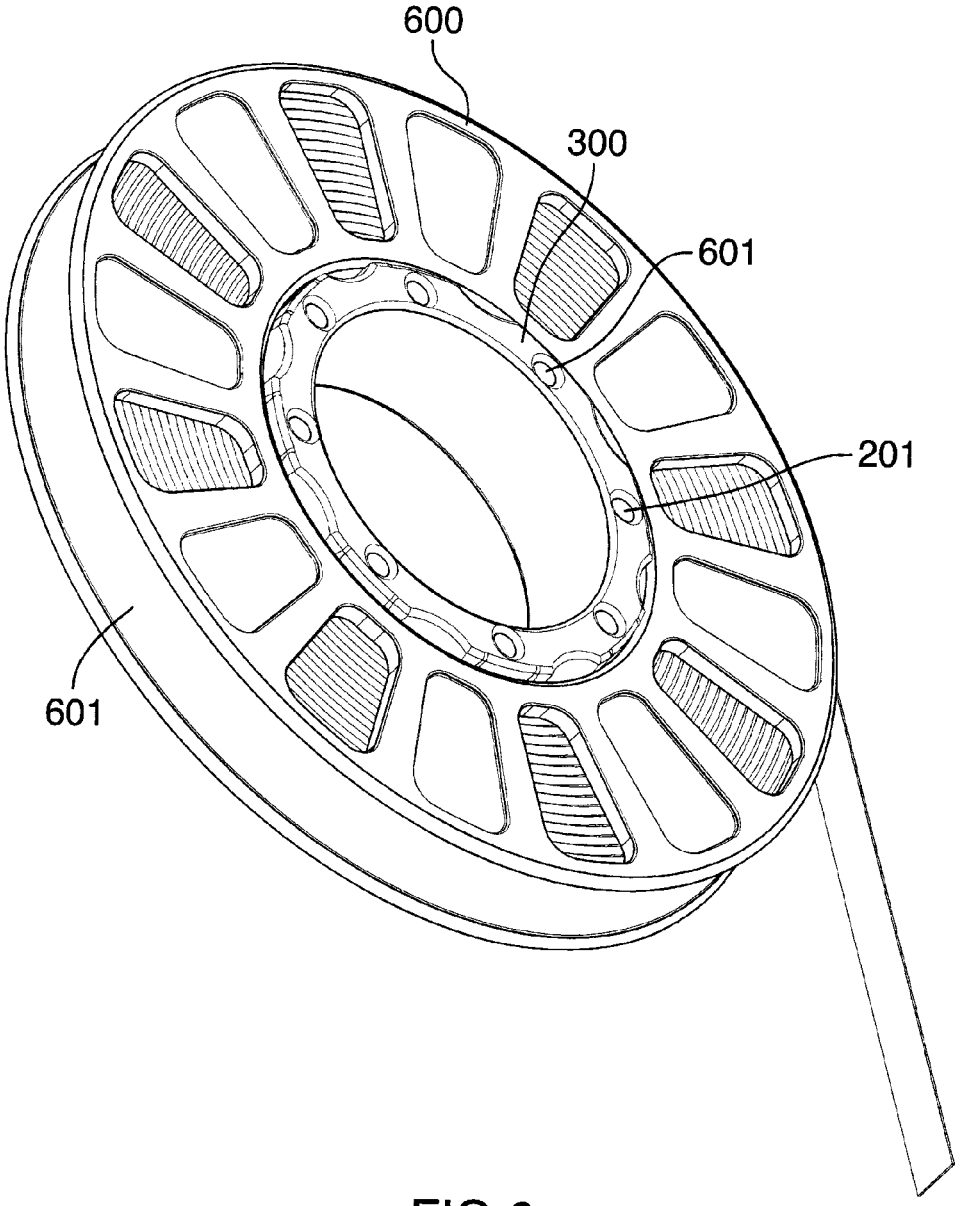
FIG. 6 is a perspective view of the second embodiment of a spool holder, with magnets embedded in the holder, engaged with a reel holding a roll of material.

The holder can be used with reel-type spools, as shown in FIG. 6 where the sleeve 300 having magnets 601 in it is engaged with a spool (reel) 600 containing wound material 601.

The holder may have one reel-like side (or flange) extending radially outward from the edge of the outer surface of the insert, but there is generally no need for this, and it can restrict access to the material in the roll. Thus it is preferred that all portions of the insert are located at a distance from the central axis of less than or equal to one half of the maximum distance of any contact point from any other contact point. This limitation also implies the preferred condition that at least one, and preferably all, contact points have a corresponding contact point angularly separated from the first contact point by about 180 degrees. However, it is only necessary that the angular distribution of the contact points be selected so as to produce a good interference fit when the holder is engaged with a spool.

Figure 7:
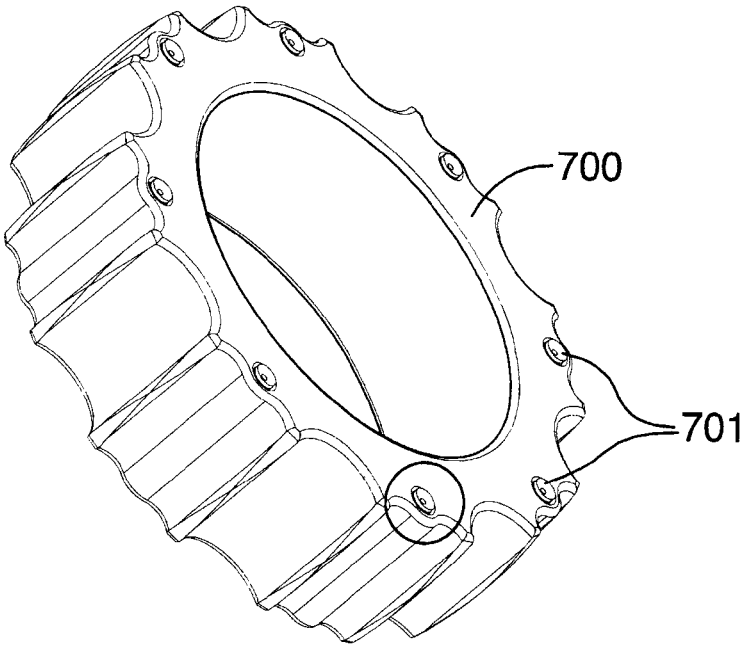
FIG. 7 is a perspective view of a third embodiment of a spool holder having small suction cups as the attachment mechanism.
Figure 8:
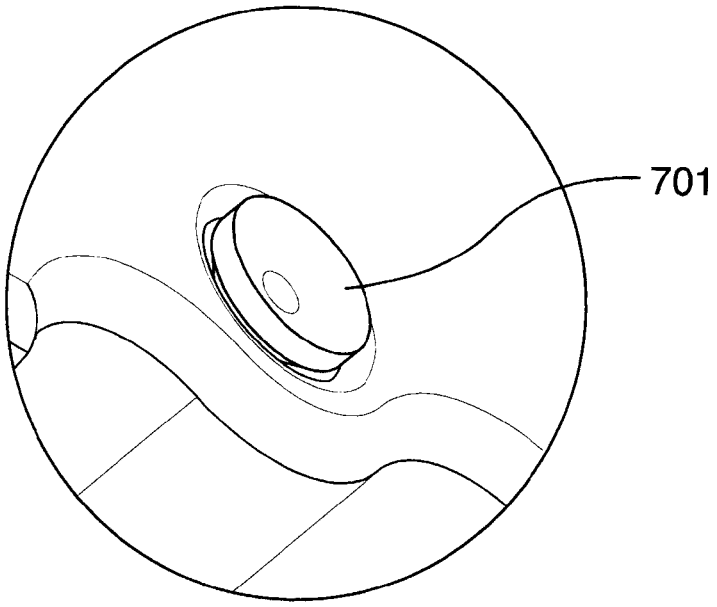
FIG. 8 is an expanded view of the circled portion of FIG. 7 showing one of the suction cups.

Other embodiments may use a non-magnetic attachment mechanism. For example, FIG. 7 shows a holder having a sleeve 700 of similar shape to that of the holder shown in FIG. 2, but with eight small suction cups 701 attached to the depicted lateral side of the sleeve 700. The suction cups may be attached to either one or both lateral sides of the insert 700. Such an embodiment may be used to releasably attach a spool to a flat non-metallic surface, such as the side of a car with a fiberglass body, a non-metallic wall or a glass surface.

Such non-magnetic embodiments can be useful in many situations. For example, when a painter on a ladder is taping the wall below crown molding near the ceiling with masking tape, which molding is generally significantly longer than a person can reach, it may be very advantageous to be able to attach the roll of masking tape to the wall while the painter uses two hands to attach to the wall a segment of tape that is still attached to the tape on the roll at one end. Then the painter can move the ladder so that, after the ladder is moved, the roll can be removed from the wall, a subsequent portion of tape, being part of one long strip being applied to the wall, can be removed from the roll and, after the painter re-attaches the roll to the wall using the holder, that portion can be applied to the wall using two hands.

Other attachment mechanisms are also possible, such as removable adhesive materials.

In general it is preferred that the attachment mechanism allow attachment of either lateral side to a supporting surface. For example, tape is often applied in both left and right hand directions so that it is useful to be able to attach the roll of tape on one side or the other.

Figure 9:
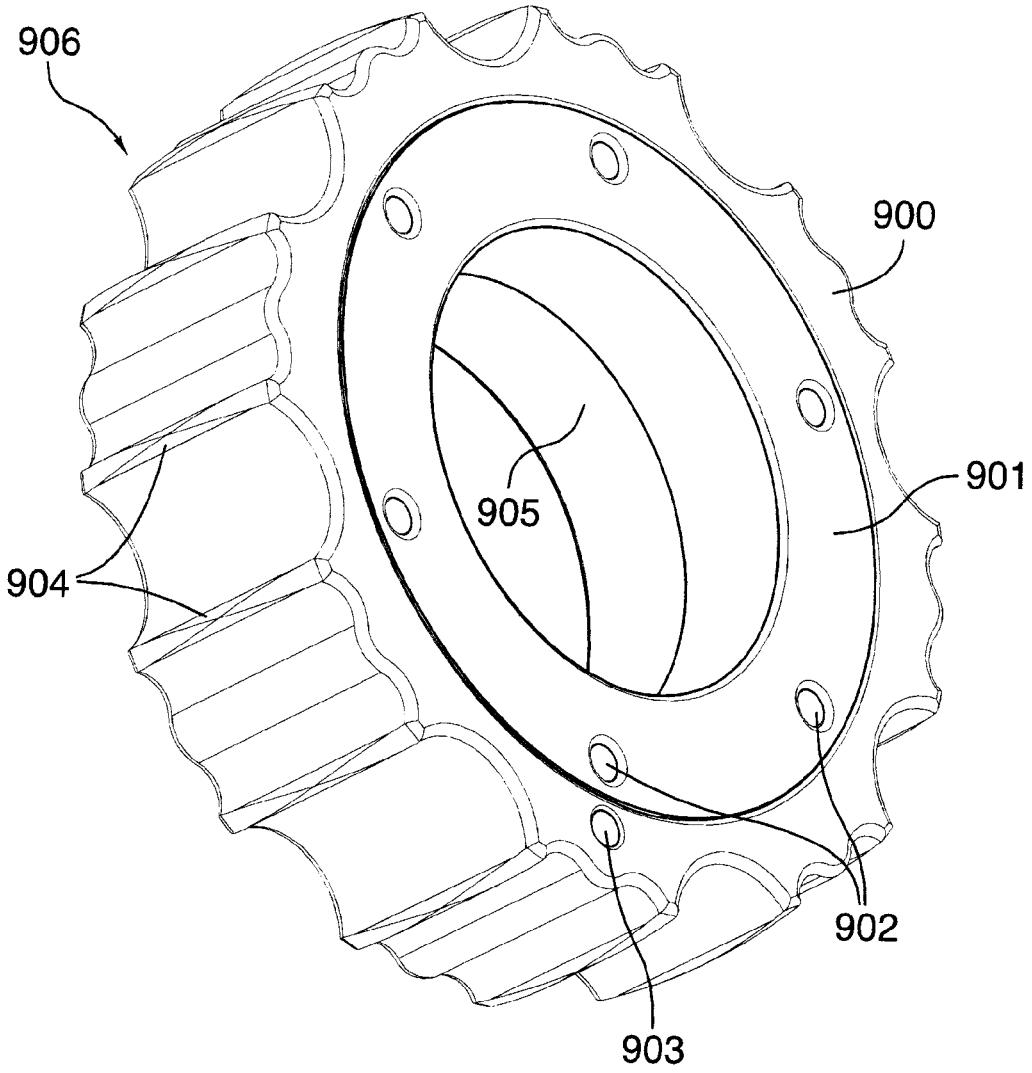
FIG. 9 is a perspective view of a fourth embodiment of a spool holder having an outer sleeve rotatably attached to an inner hub having embedded magnets as an attachment mechanism.
Figure 10:
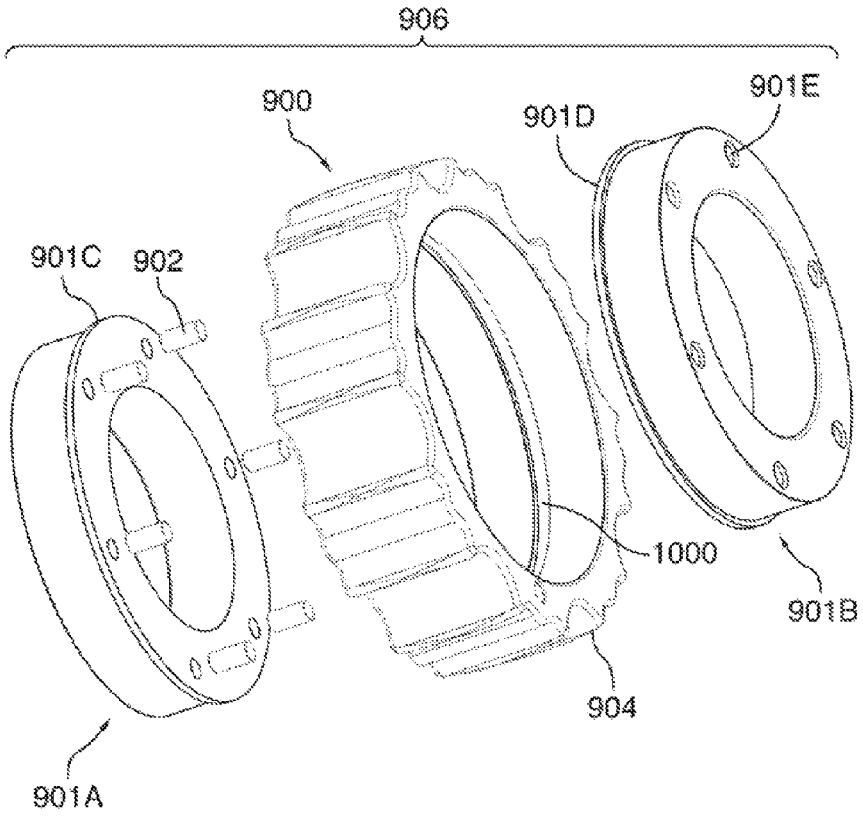
FIG. 10 is an exploded view of the embodiment shown in FIG. 9.

A more complex embodiment of a spool holder is depicted in FIGS. 9 and 10, where the holder 906 includes an outer sleeve 900 having a similar outer surface to that of the embodiment shown in FIG. 2. The insert is rotatably attached to an inner hub 901. In this embodiment, the attachment mechanism consists of the hub 901 having six cylindrical magnets 902 disposed in six receptacles in the hub 901. The hub 901 has a cylindrical inner surface 905 defining a cylindrical hole or opening through the holder 906.

The sleeve may also have a detent feature, which may employ a magnet 903 in the sleeve 900 aligned so that the proximate portions of each magnet 902 in the hub 901 have opposite polarity to the magnet 903 in the sleeve 900 so that they will attract when the sleeve 900 is rotated to a position where one of the magnets 902 in the hub 901 is close to the magnet 903 in the sleeve 900, so that the holder 906 will tend to stay in this position, in the absence of non-gravitational external force. Alternatively, more than one magnet may be placed in the sleeve 900, or metal rods or pins could be inserted, in combination with a ratchet inside the hub, to prevent a spool and roll from freely spinning around the hub 901 without non-gravitational external force being applied to rotate the tape for the purpose of dispensing.

FIG. 10 shows an exploded view of the holder 906 of FIG. 9. The hub 901 comprises a left piece 901A and a right piece 901B of about equal widths and each having six cylindrical receptacles 901E in the same relative locations and sized to accept six cylindrical magnets 902. The sleeve 900 has a groove 1000 in its inner surface sized to receive and engage a flange 901C on the left hub piece 901A and a flange 901D on the right hub piece 901B. The width of each flange 901C,

901D is slightly less than one half of the width of the groove 1000, and the outer diameter of each flange 901C, 901D is greater than the inner diameter of the sleeve, but less than the diameter of the inner portion of the groove, so that the two hub pieces 901A, 901B may be pressed into the sleeve 900 and held in place by the protrusion of the flanges 901C, 901D into the groove 1000. The outer diameter of the non-flange portions of the hub pieces 901A, 901B is slightly less than the inner diameter of the sleeve 900 so that they may rotate relative to the sleeve 900.

The hub 901 can alternatively use suction cups, similar to the embodiment shown in FIG. 7, as the attachment mechanism.

The embodiment of FIGS. 9 and 10 can be used, for example, to attach a roll of tape to the side of a car so that the user can remove tape wound in a roll on the spool by pulling on the tape while the roll remains attached to the car and rotates about the hub 901, while the hub remains in a fixed rotational position relative to the car.

Many other variations are possible. For example, the insert may have a solid central portion with arms extending from it having contact points at the ends of the arms at the same distance from the central axis so that they lie on a notional cylinder on the central axis. At least two arms are required, although to achieve a good interference fit, particularly with a spool made of a more deformable material, at least three or four arms are preferred, and more preferably at least six, eight or sixteen arms. In such embodiments, the attachment mechanism may be, for example, a magnet embedded the central portion or a number of magnets embedded in a plurality of the arms. Suction cups or other means may alternatively be used as the attachment mechanism.

While all the embodiments described above employ an insert with contact points at a fixed distance from the center of the insert (so that the outer diameter of the holder must be matched with the inner diameter of the spool), embodiments that allow the distance to vary are also possible. Such embodiments may have, for example, eight contact points (each similar to item 904 in FIG. 9), each at the outer end of an adjustable extension from the insert, so that all the extensions can be moved outward or inward simultaneously at the same rate, for example, by rotating a dial.

In order to produce an interference fit, at least one of the insert and spool must be deformable to some degree. Generally, spools, such as those made of paper, are deformable to a sufficient degree that an insert made of completely rigid material, such as iron, will work as described. However, in order to handle rigid spools, such as those formed from hard plastic, it is preferable that the insert, or at least the portions of the insert at and near the contact points, be made of a deformable material, such as a deformable plastic.

Spool holders may be sold with spools of material, sized to fit a particular spool such as a standard 3 inch (76 mm) inner diameter spool, or they may be sold separately, either individually or in sets of differently sized holders with varying diameters. The holders may be sold in a kit including instructions on how to use the holder to attach a spool/roll to a supporting surface. Such instructions may be expressed in words, instructing the user to insert the holder into the cylindrical hole in the spool to bring the contact points into frictional engagement with the inner cylindrical surface of the spool, and attach one of the lateral sides of the insert to a supporting surface using the attachment mechanism. For example, in the case of a magnetic holder, the user may be instructed to place one lateral surface of the holder proximate to a supporting surface comprising ferromagnetic material. Alternatively, the instructions can be, or include, one or more pictures or diagrams showing the holder inserted in a spool and attached to a supporting surface.

The spool holders are well suited for use in advertising, for example by placing advertising information on the lateral sides or on the inner cylindrical surface for holders with a cylindrical hole. When used for advertising, it may be desirable to make the cylindrical hole in the sleeve smaller than it would otherwise be to provide more lateral surface area for printing advertising information on.

The magnetic embodiments also have a secondary use as a device to attach material, such as paper, to a metallic surface, just like a common refrigerator magnet. In a shop, such as a collision repair shop, the natural place to store a spool holder would be on the side of a metal door, cabinet, toolbox or bench, where it may also be desirable to attach paperwork for viewing by workers in the shop. In this context, the use of advertising on the surfaces of the holder is particularly effective.

While the sleeve embodiments described above generally have a cylindrical hole, other embodiments may employ non-cylindrical holes. Various hole shapes may be desirable, for example to allow placement on special holders, or simply for a special aesthetic effect.

While it is generally preferred that all portions of the insert are located at a distance from the central axis of less than or equal to one half of the maximum distance of any contact point from any other contact point, in some embodiments, the insert may have one or two outer flanges that cover the outer surface of the spool. For example, the insert may comprise two halves, attachable to each other after being inserted into either side of the hole in the spool. With flanged outer sides, the insert then forms a type of reel with an outer portion on either or both sides covering a portion of the outer side of the spool and possibly also a portion of the outer side of the roll of material on the spool.

As used herein, a cylinder is, unless otherwise qualified, a right cylinder, which is a surface having a central axis (a straight line), the surface being spanned by a family of circles of fixed radius (one half of the diameter) centered on the axis at all points along the axis over a finite distance along the axis. The radius and diameter of the cylinder are, respectively, equal to the radius and diameter of the circles.

It should be emphasized that the above-described embodiments of the present invention, particularly, any "preferred" embodiments, are only examples of implementations, merely set forth for a clear understanding of the principles of the invention. Many variations and modifications may be made to the above-described embodiment(s) of the invention as will be evident to those skilled in the art.

Where, in this document, a list of one or more items is prefaced by the expression "such as" or "including", is followed by the abbreviation "etc.", or is prefaced or followed by the expression "for example", or "e.g.", this is done to expressly convey and emphasize that the list is not exhaustive, irrespective of the length of the list. The absence of such an expression, or another similar expression, is in no way intended to imply that a list is exhaustive. Unless otherwise expressly stated or clearly implied, such lists shall be read to include all comparable or equivalent variations of the listed item(s), and alternatives to the item(s), in the list that a skilled person would understand would be suitable for the purpose that the one or more items are listed.

The words "comprises" and "comprising", when used in this specification and the claims, are to used to specify the presence of stated features, elements, integers, steps or components, and do not preclude, nor imply the necessity for, the presence or addition of one or more other features, elements, integers, steps, components or groups thereof.

Nothing in this specification or the claims that follow is to be construed as a promise.

The scope of the claims that follow is not limited by the embodiments set forth in the description. The claims should be given the broadest purposive construction consistent with the description as a whole.

What is claimed is:

1. A spool holder for holding a spool, the spool having a width, an inner cylindrical surface defining a cylindrical hole having a diameter, the spool having an inner diameter being the diameter of the cylindrical hole, the spool holder comprising an insert comprising magnetized material and having an outer surface configured to releasably engage the inner surface of the spool to create an interference fit between the outer surface of the insert and the inner surface of the spool when the insert is inserted into the hole, the outer surface of the insert having a plurality of spool contact points separated from each other by troughs in the outer surface wherein the magnetized material of the insert is configured to releasably attach the insert directly to a supporting surface comprising ferromagnetic material; and wherein the insert comprises a receptacle configured to receive a magnet, the magnetized material comprises a magnet disposed in the receptacle, and the width of the insert is greater than the width of the spool.

2. The spool holder of claim 1 wherein the insert has a central axis and each contact point comprises a portion of the outer surface of the insert, the plurality of the contact points being at a distance greater than one half of the inner diameter of the spool from the central axis, the contact points being angularly spaced apart to engage the inner surface of the spool to produce an interference fit.

3. The spool holder of claim 1 wherein the insert has left and right lateral sides separated by a distance and being perpendicular to a central axis of the insert, and a width being the distance between the lateral sides, wherein the outer surface is bordered by the lateral sides.

4. The spool holder of claim 1 wherein each contact point is separated from each other contact point by a contact point distance, and wherein all portions of the insert are located at a distance from the central axis of less than or equal to one half of the maximum contact point distance.

5. The spool holder of claim 1 wherein the insert comprises a sleeve having a hole centered on a central axis of the insert.

6. The spool holder of claim 5 wherein the hole of the insert is a cylindrical hole having a diameter equal to at least 50% of the inner diameter of the spool.

7. The spool holder of claim 1 wherein each spool contact point is at a distance from the central axis and the distances of the contact points from a central axis of the spool are equal and less than 0.53 times the inner diameter of the spool and greater than one half of the inner diameter of the cylindrical hole of the spool.

8. The spool holder of claim 7 wherein the insert comprises eight contact points, each contact point being angularly spaced apart from the other seven contact points by at least forty degrees.

9. The spool holder of claim 8 wherein the insert comprises sixteen contact points, each contact point being angularly spaced apart from the other fifteen contact points by at least twenty degrees.

10. The spool holder of claim 1 wherein the insert comprises a plurality of receptacles configured to receive magnets, and the magnetized material comprises a plurality of magnets disposed in the receptacles.

11. The spool holder of claim 10 wherein the magnets are cylindrical and are oriented with central axes parallel to a central axis of the insert, and the magnets extend from near one lateral side of the insert to near the other lateral side so that each magnet can magnetically engage with the supporting surface comprising ferromagnetic material when either lateral side of the insert is placed in close proximity to the supporting surface.

12. The spool holder of claim 1 wherein, the supporting surface is vertically oriented, and when the holder is engaged with the spool holding a roll of material and attached to the vertical supporting surface comprising ferromagnetic material, the magnetic strength of the magnetized material is sufficient to maintain the attachment to the surface.

* * * * *